US005610617A

United States Patent [19]

Gans et al.

[11] Patent Number: 5,610,617

[45] Date of Patent: Mar. 11, 1997

[54] DIRECTIVE BEAM SELECTIVITY FOR HIGH SPEED WIRELESS COMMUNICATION NETWORKS

[75] Inventors: Michael J. Gans, Monmouth Beach; Yu S. Yeh, Freehold, both of N.J.

[73] Assignee: Lucent Technologies Inc., Murray Hill, N.J.

[21] Appl. No.: 503,758

[22] Filed: Jul. 18, 1995

[51] Int. Cl.[6] ..... H01Q 3/22

[52] U.S. Cl. ..... 342/373; 342/374; 342/372; 342/148; 455/135

[58] Field of Search ..... 342/373, 374, 342/372, 368, 148, 91; 455/135

[56] References Cited

U.S. PATENT DOCUMENTS

| | | | |
|---|---|---|---|
| 4,316,192 | 2/1982 | Acoraci . | |
| 4,424,500 | 1/1984 | Viola et al. | 333/128 |
| 4,450,585 | 5/1984 | Bell | 455/135 |
| 4,639,732 | 1/1987 | Acoraci et al. | 342/371 |
| 4,652,879 | 3/1987 | Rudish et al. . | |
| 4,882,588 | 11/1989 | Renshaw et al. . | |
| 4,951,061 | 8/1990 | Lee . | |
| 4,965,605 | 10/1990 | Chang et al. | 343/700 MS |
| 5,001,492 | 3/1991 | Shapiro et al. | 343/700 MS |
| 5,073,976 | 12/1991 | Kennedy | 455/161 |
| 5,086,302 | 2/1992 | Miller . | |
| 5,179,386 | 1/1993 | Rudish et al. . | |
| 5,325,101 | 6/1994 | Rudish et al. . | |
| 5,373,299 | 12/1994 | Ozaki et al. | 342/373 |
| 5,434,575 | 7/1995 | Jelinek et al. | 342/365 |

OTHER PUBLICATIONS

Anaren Brochure for Microwave Components.
Northern Telecom, Inc. Brochure for Smart Antennas.

*Primary Examiner*—Thomas H. Tarcza
*Assistant Examiner*—Dao L. Phan

[57] ABSTRACT

The present invention provides a wireless communication system which employs Butler matrix combiners and circuit switching at transmitter and receiver antenna arrays to provide directive beamwidth capabilities. Such narrow beamwidths permit the communication system to determine and select the transmission path having an optimum signal quality. The antenna arrays are integrated in a multilayer construction which reduces power consumption, increases the coverage range, improves the efficiency of the antenna array, and which has lower fabrication costs.

26 Claims, 6 Drawing Sheets

DIRECTIVE BEAM SELECTIVITY FOR HIGH SPEED WIRELESS COMMUNICATION NETWORKS

BACKGROUND OF THE INVENTION

1. Technical Field

The present invention relates to an apparatus and method for directive antenna beam selectivity for high speed wireless communication systems.

2. Description of Related Art

Personal communication systems, indoor wireless networks and mobile cellular radio networks are rapidly growing and developing communication systems. Natural phenomena, such as multipath distortion, signal amplitude degradation and signal interference, which occurs during transmission, limit practical current data transmission rates to about 10 Mbps which is suitable for current needs. However, projections for future communication systems suggest that this 10 Mbps data rate may not be adequate to accommodate the volume of data expected to be transmitted on such systems. In order to increase the data transmission rates, communication systems having the capability to overcome such natural phenomena are necessary.

One attempt to increase the data rates has been to combine antenna elements with adaptive combiners. In addition, techniques have been implemented for analyzing the signal quality for various antenna elements and for selecting between the best combination of transmitter and receiver antenna sectors so as to improve the signal-to-noise ratio and reduce the signal interference and the multipath distortion. However, such techniques for sampling and selecting the proper strategies typically require active elements, such as low noise preamplifiers for receivers and/or high gain amplifiers for transmitters, at each antenna element. Moreover, employing highly directive adaptive antenna arrays for remote transmitters and receivers with a large number of active elements, significantly increases the cost of the transmitters and receivers, in particular, transmitters and receivers which operate in the millimeter frequency spectrum.

In addition, the criterion analyzed to determine the best transmission path is the signal amplitude. For instance, an article entitled "Enabling Technologies for Wireless In-Building Network Communications—Four Technical Challenges, Four Solutions" by Thomas A. Freeburg describes an antenna having six equal 60° directional antennas used to transmit and receive data. Signal sampling and selection protocol identifies the best signal relationship between transmitter and receiver sectors for each individual data transmission. The criterion used by the sampling and selection protocol for determining which transmitting and receiving antenna sectors provide the desired signal is the signal amplitude. However, using signal amplitude alone does not ensure that the transmission path selected is the optimum path.

Therefore, a need exists for a communication system which utilizes directive beam antennas and which selects the proper transmission path based upon signal amplitude, signal interference and multipath distortion. Moreover, a need exists for a low cost directive beam antenna array for utilization in the communication system.

SUMMARY OF THE INVENTION

The present invention provides a multilayered streamlined antenna array construction which reduces power consumption, increases the coverage range, improves the efficiency of the antenna array, and which has lower fabrication costs. The multilayered antenna array includes a first layer having a selectively controllable switch matrix, preferably, a diode array switch matrix. The switch matrix has an input port and a plurality of output ports. A second layer having a first array of Butler matrices is displaced from the first layer. Each Butler matrix array has a plurality of input ports and a plurality of output ports, wherein one input port is connected to a corresponding switch matrix output port. Preferably, the first array of Butler matrices is configured to arrange the phase of an input signal along the x-axis. A third layer having a second array of Butler matrices is displaced from the second layer. Each Butler matrix array for the third layer has a plurality of input ports and a plurality of output ports, wherein one input port is connected to a corresponding output port of the first array. Preferably, the second array of Butler matrices is configured to arrange the phase of the input signal along the y-axis. The antenna array also includes a fourth layer having a plurality of antenna elements, such as patch antennas, positioned thereon. Each antenna element is coupled to a corresponding output of the second array of Butler matrices.

Preferably, each layer of the multilayered antenna array is constructed in a stripline configuration. The stripline configuration includes two parallel copper ground planes positioned about each layer and displaced therefrom by dielectric material.

The present invention also provides a communication system for high speed wireless data transmission. The communication system includes at least one multilayered antenna array having a plurality of antenna elements positioned on a first layer coupled to at least one Butler matrix array positioned on a second layer. Preferably, the Butler matrix array has a plurality of outputs wherein one output is coupled to one antenna element. In addition, the Butler matrix array has a plurality of inputs selectively coupled to data transmission signals. A transmitter network is provided to generate and process data transmission signals for transmission by the antenna array. The transmitter network includes an output port selectively connectable to one input of the at least one Butler matrix array. A processor is coupled to the transmitter network and to means for connecting the output port of the transmitter network with at least one of the plurality of input ports of the Butler matrix array.

The communication system further includes a receiver network coupled to the multilayered antenna array and configured to receive data transmission signals.

Preferably, the communication system processor includes selecting means for determining which transmitter antenna element and which receiver antenna element provide the optimum transmission path. The determination of the optimum transmission path is based upon signal-to-noise ratio and multipath signal distortion.

The present disclosure also provides a method for determining the optimum transmission path in narrow beam wireless transmission networks based upon signal-to-noise ratio and multipath signal distortion.

BRIEF DESCRIPTION OF THE DRAWINGS

Preferred embodiments of the invention are described hereinbelow with reference to the drawings wherein.

DETAILED DESCRIPTION OF PREFERRED EMBODIMENTS

Figure 1:
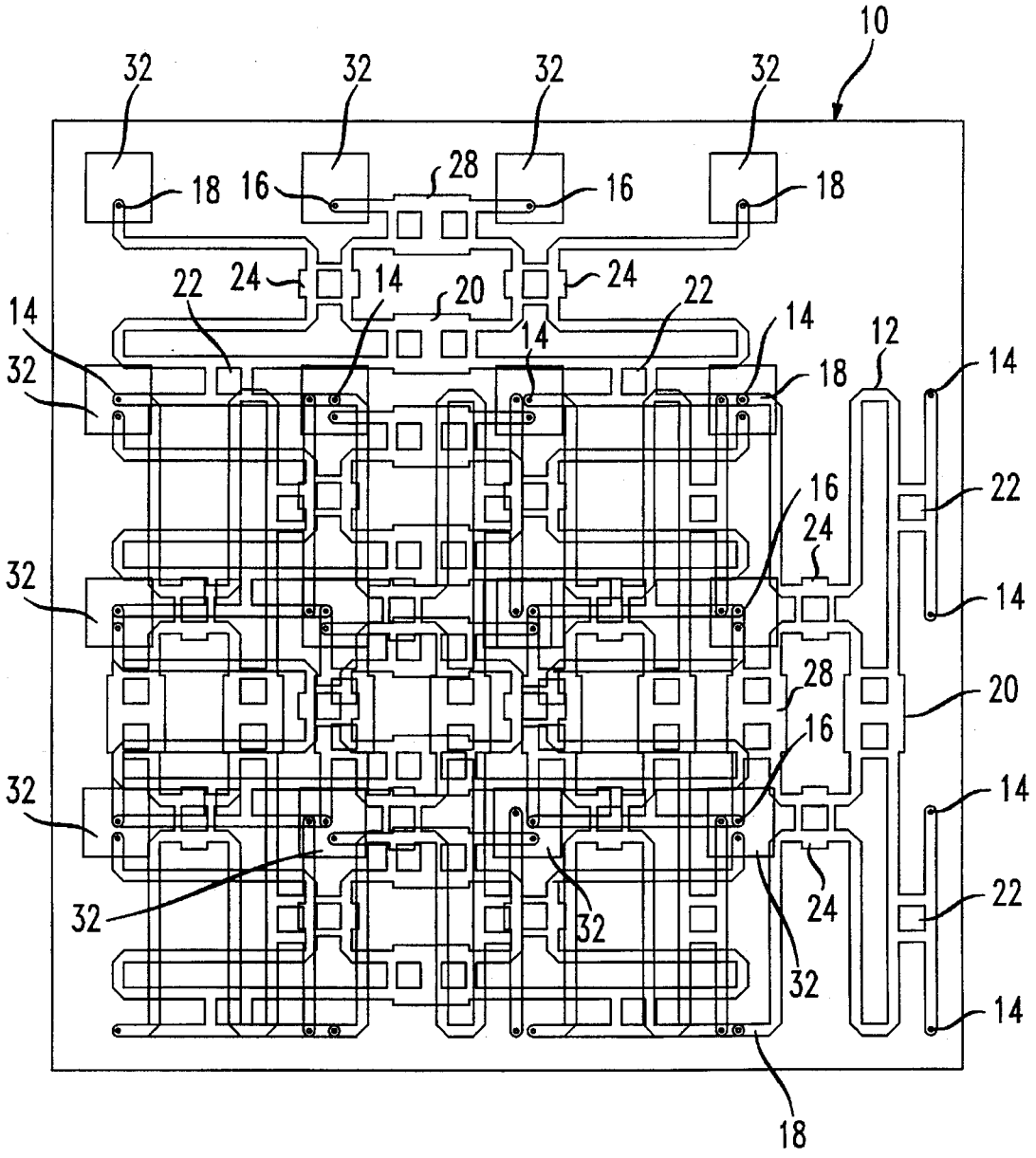
FIG. 1 is an overlay view of an integrated multilayered antenna array according to the present invention.

The present disclosure relates to communications systems which employ arrays of power sharing devices, such as Butler matrix combiners, and circuit switching at the transmitter and receiver antenna arrays to provide directive beamwidth capabilities. Such narrow beamwidths permit the communication system to determine and select the transmission path having an optimum signal quality. Referring to FIG. 1, the antenna arrays 10 utilized in the communication system are integrated in a multilayer construction, which reduces power consumption, increases the coverage range, improves the efficiency of the antenna array, and which has lower fabrication costs.

The communication system according to the present invention may be used for high speed indoor wireless communications, as well as high speed outdoor wireless communications, such as cellular communications. The description for the integrated antenna array shown in FIGS. 1–7 relates to an exemplary antenna array configuration for indoor wireless communication applications. In indoor wireless communications, beamwidths of 15° or less with a hemispherical (i.e., 360°) field of view, are preferred. To satisfy this criterion, seven 16-element antenna arrays fed by Butler matrices are utilized.

Figure 2:
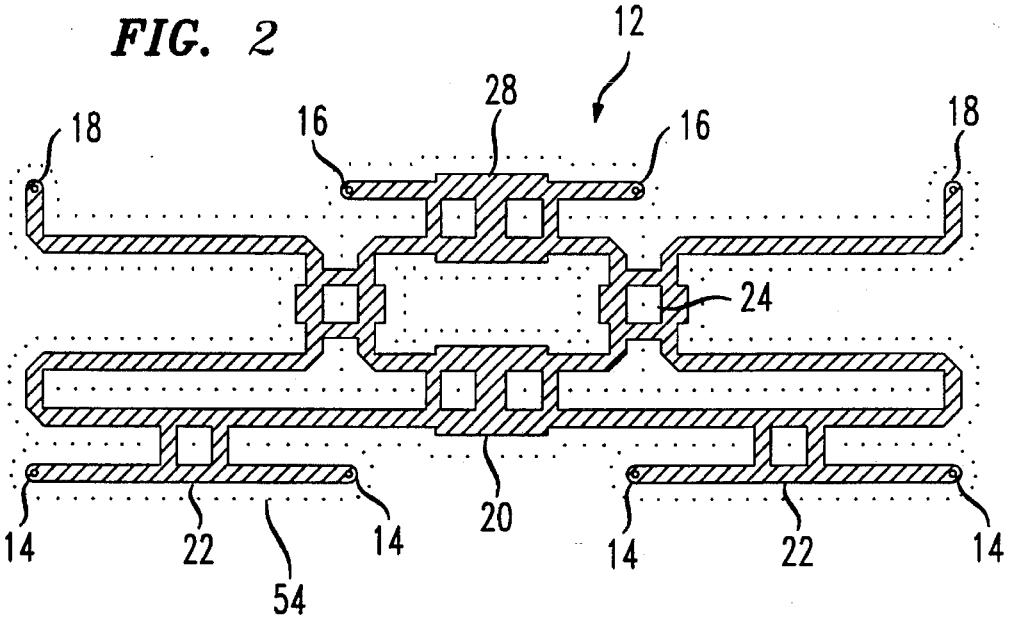
FIG. 2 is an exemplary stripline construction for a 4×4 Butler matrix utilized in the integrated antenna array of the present invention.
Figure 3:
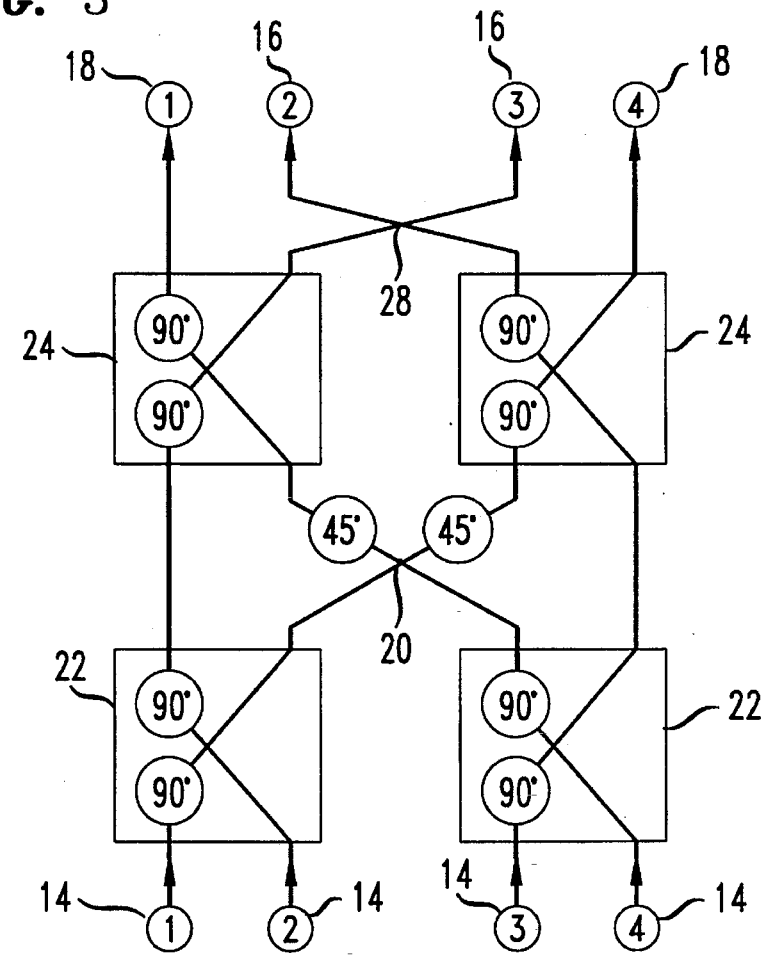
FIG. 3 is a schematic block diagram of the 4×4 Butler Matrix of FIG. 2.

FIGS. 2 and 3 illustrate an integrated stripline construction and a corresponding schematic diagram for one 4×4 Butler matrix 12 utilized on the multilayered integrated antenna array 10. Each 4×4 Butler matrix 12 has four input ports 14 and four output ports 16 and 18. Each input port is decoupled from the other input ports so that there is no inherent loss, even if signals are combined in the same frequency band. Butler matrices are configured so that a signal applied at one input port is divided equally among all the output ports, such that the signal at each output port has substantially the same amplitude, but the phase for each output is different. In this configuration, the phases of the signals from the output ports form distinctive narrow beams, unique to each input port.

The input ports 14 for the matrix are coupled to cross-over network 20 via hybrid couplers 22. Preferably, the hybrid couplers are configured to equally divide the input power between the two output ports, with the phase of the output port furthest from the input port lagging that of the output nearest to the input port by 90°. The cross-over networks are defined by two such 2×2 Butler matrices in cascade and are provided to reorder the location of the sequence of outputs without electromagnetic coupling the outputs, all the while maintaining the crossing striplines on one layer. A more derailed description of the cross-over networks is described in J. S. Wight, W. J. Chudobiak & V. Makios, "A Microstrip & Stripline Crossover Structure" IEEE Transactions on Microwave Theory & Techniques, May 1976, page 270, which is incorporated herein by reference. Hybrid couplers 24 have similar power loss and phase shift characteristics as couplers 22 and are provided to complete the coupling of each input port to all output ports in the orthogonal equal amplitude manner of a Fast Fourier Transform. Output ports 16 are coupled to the matrix via cross-over network 28 and outputs ports 18 are coupled to hybrid couplers 24 as shown. The configuration shown in FIGS. 2 and 3 provides the narrow beam capabilities for the system of the present invention.

Figure 4:
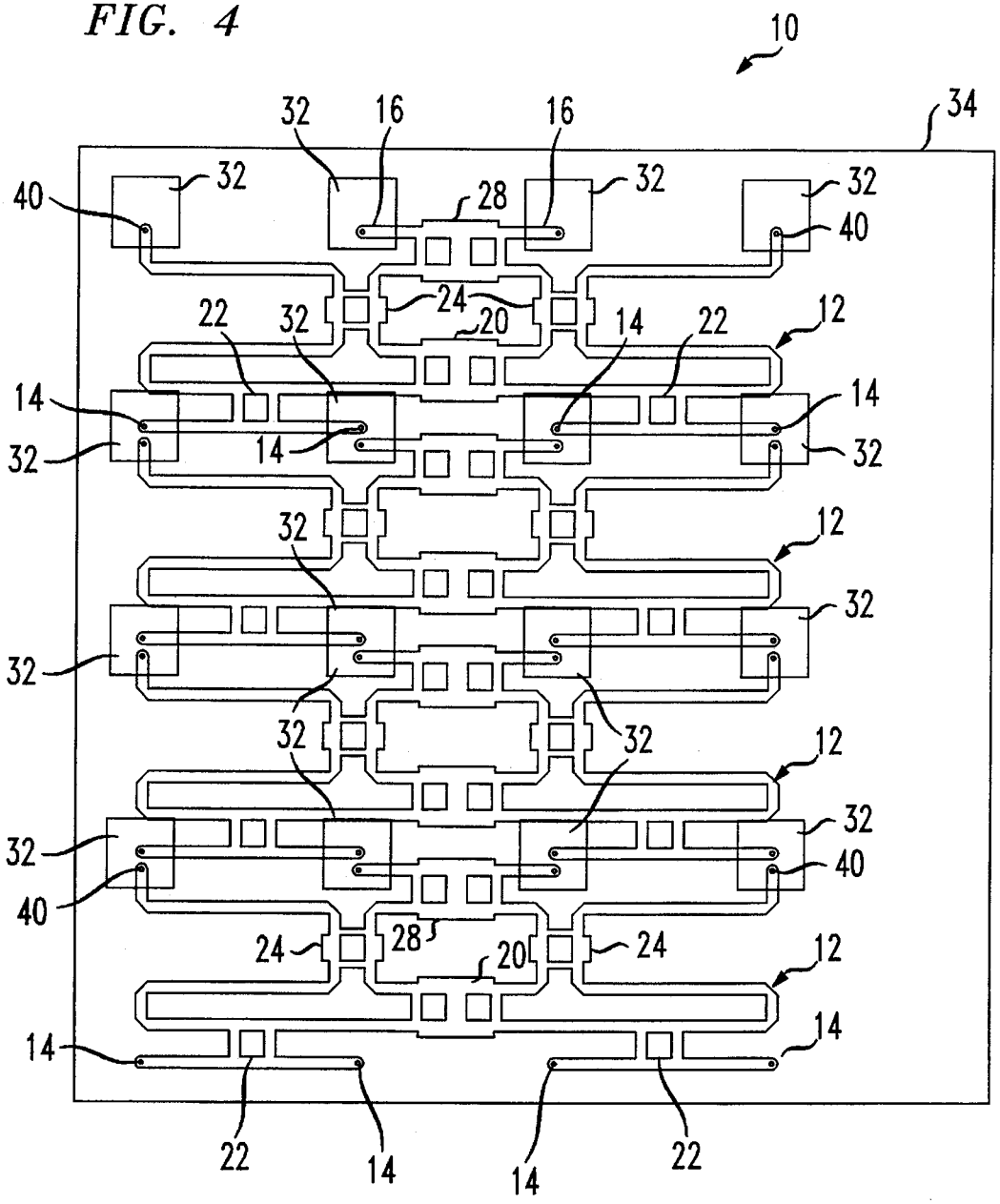
FIG. 4 is an overlay view of two layers of the integrated multilayered antenna array of FIG. 1, illustrating sixteen patch antennas overlaying four 4×4 Butler matrices aligned in series.
Figure 5:
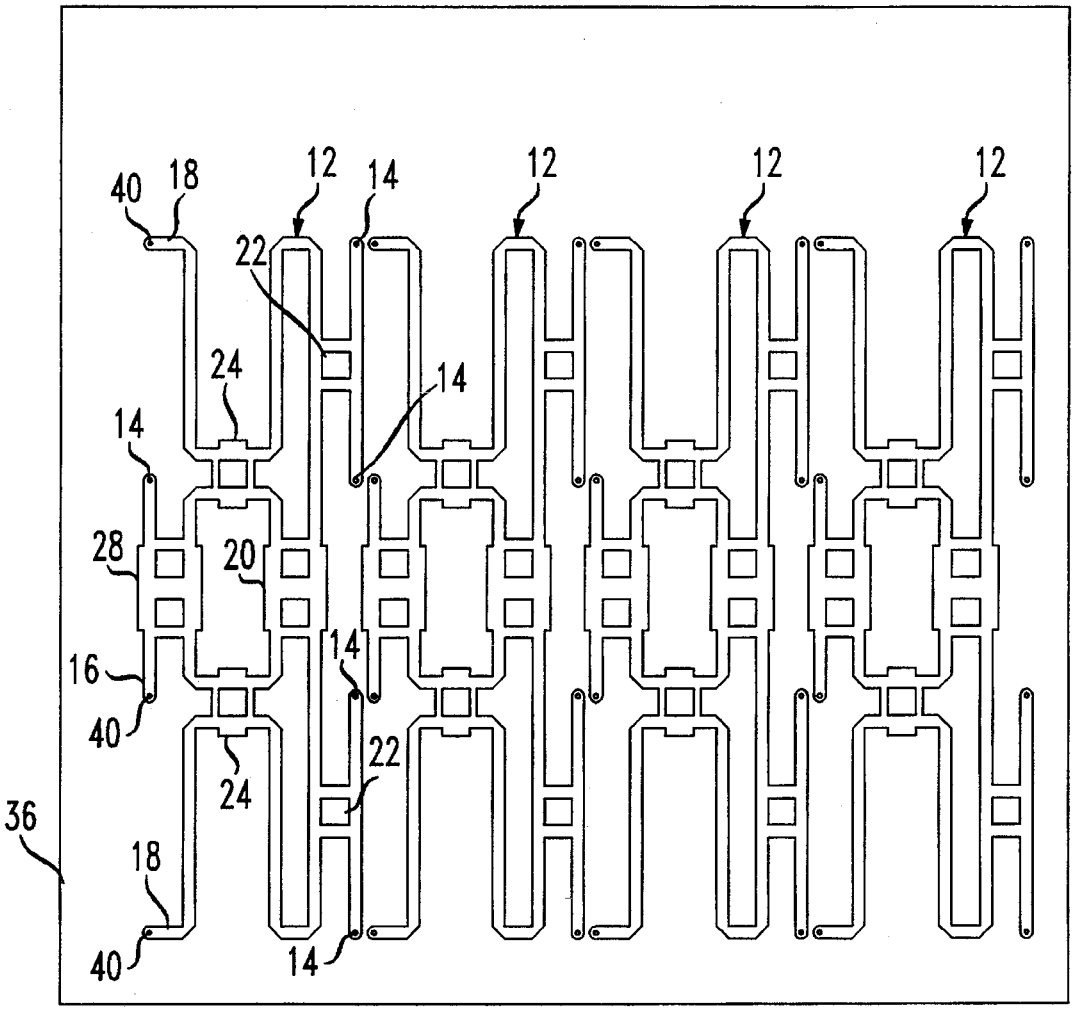
FIG. 5 is an exemplary stripline construction for a third layer for the multilayered antenna array of FIG. 1, illustrating four 4×4 Butler matrices aligned in series.
Figure 6:
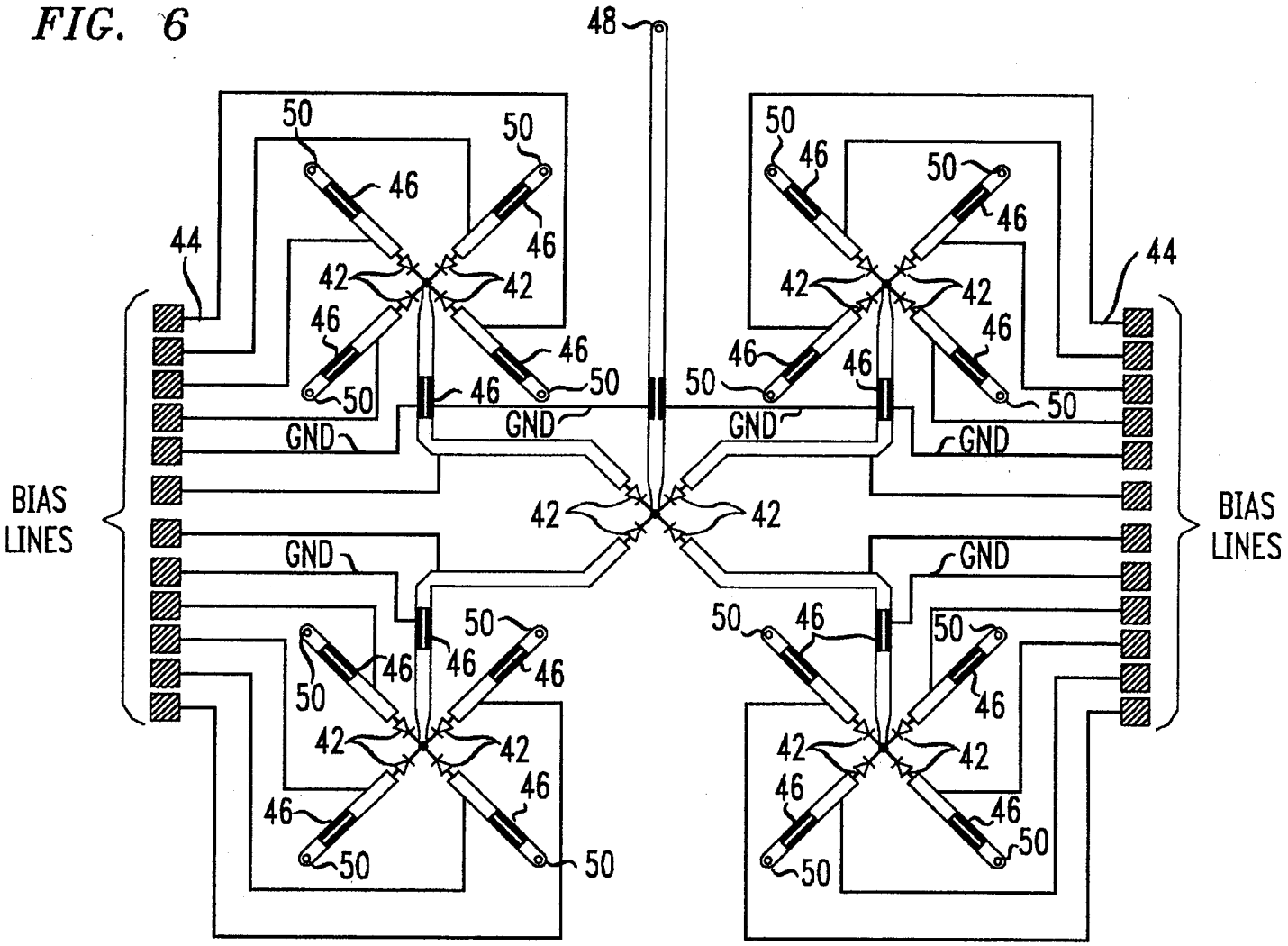
FIG. 6 is a schematic diagram for a fourth layer of the integrated antenna array of FIG. 1, illustrating a single pole 16 throw RF switch.
Figure 7:
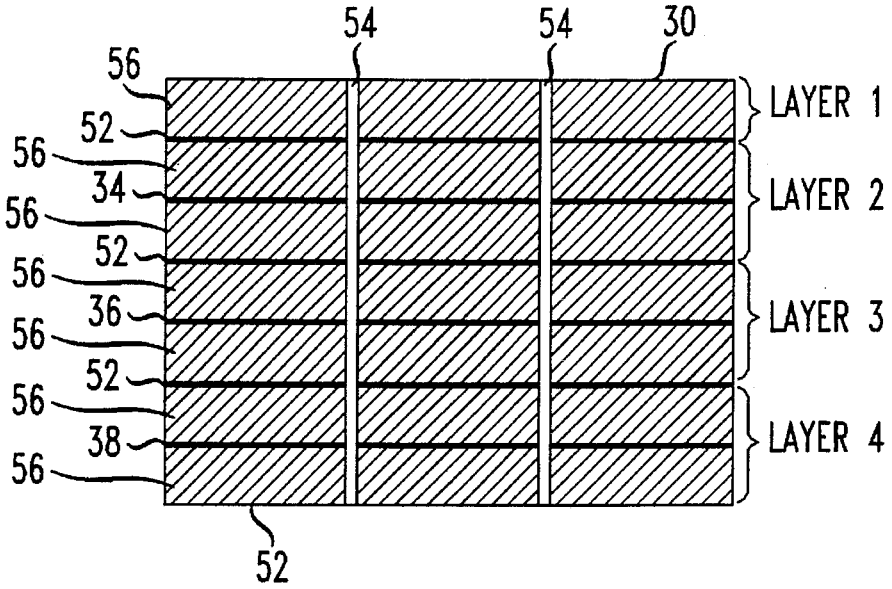
FIG. 7 is a partial cross-sectional view of the four layered integrated antenna array of FIG. 1.

FIGS. 4–7 illustrate the layered configuration for the integrated antenna array 10. As shown in FIGS. 4 and 7, the first (or top) layer 30 has the antenna elements 32 distributed therealong. Preferably, the antenna elements are defined by a square array of patch antennas. However, other known antenna elements may be utilized, for example, dipole, monopole and slot antenna elements. Preferably, each patch antenna is etched into a conductive medium, such as copper.

The second layer 34 of the integrated multilayered antenna array includes Butler matrices 12 in a vertical arrangement, as shown in FIG. 4. The third layer 36 of the integrated multilayered antenna array, includes Butler matrices 12 in a horizontal arrangement, as shown in FIG. 5. Butler matrices arranged in the horizontal direction are provided to arrange the phase progression along the x-axis and Butler matrices arranged in the vertical direction are provided to arrange the phase progression along the y-axis. The fourth layer 38 schematically shown in FIG. 6, is a diode switch matrix used to selectively direct data transmission signals to the proper Butler matrix input determined for the optimum transmission path. In this embodiment the switch matrix is a single pole, sixteen throw RF switch having an input port 48 and a plurality of output ports 50 having control lines 44 coupled to the controller 60, shown in FIG. 8.

Conductive via holes 40 are used for signal connections between the antenna elements 32, the Butler matrices 12 and the switch matrix 38. These conductive via holes are holes between layers which are plated with a conductive material, such as copper, to form a shorting post between the layers.

For the seven array embodiment described for indoor wireless applications, a single pole seven throw RF switch is controlled by the controller 16 to choose between the seven arrays. Utilizing the above described antenna array at frequencies near 20 GHz, the complete antenna array may occupy approximately a three cubic inch space to share the antenna aperture and to provide 360° directive beam coverage when receiving transmitted data and/or to radiate many narrow beams of about 15° beamwidth.

Referring to FIG. 6, the fourth layer 38 of the array is a cascade of two stages of single-pole, quadruple-throw diode switches 42. To choose the appropriate port, a bias voltage is applied to the bias lines 44 which correspond to the port. In this configuration, the diode arrays at each junction should have appropriate characteristics so that the disconnected striplines do not introduce excessive parasitic reactance into the selected port. Techniques for fabricating such diodes and/or diode arrays, as well as the stripline construction of the integrated array, are known in the art and include Monolithic Microwave Integrated Circuit (MMIC) techniques. D.C. blocks 46, which are essentially transparent to the RF, are employed in the stripline, as shown in FIG. 6, to isolate the bias circuits from the high frequency signals.

Referring now to FIG. 7, a cross-sectional view of a portion of the multilayered antenna array 10 is illustrated. The second, third and fourth layers of each integrated antenna array is preferably fabricated utilizing a stripline construction to reduce signal interference. As shown, parallel plate ground planes 52 are utilized in the stripline construction are between about 2 mils and about 5 mils in thickness, and are preferably fabricated of copper cladding. However, other known types of conductive materials, e.g., metals and alloys may be utilized. Further, the thickness of the parallel plates may vary depending upon the conductive medium utilized. Conductive via holes 54 between the ground planes placed around the stripline, as shown in FIG. 2, are used for mode suppression which may be caused by the parallel plate mode of the stripline configuration. The conductive via holes 54 are holes between each ground plane which are plated with a conductive material, e.g., copper, to form conductive shorting posts connecting the two ground planes of the stripline. The spacing between each ground plate may be a 10 rail thick Tellite substrate 56 having a relative permittivity ($\epsilon_r$) of 2.39. Alternatively, a 20 mil thick Alumina substrate having a relative permittivity ($\epsilon_r$) of 9.0 may be utilized.

Figure 8:
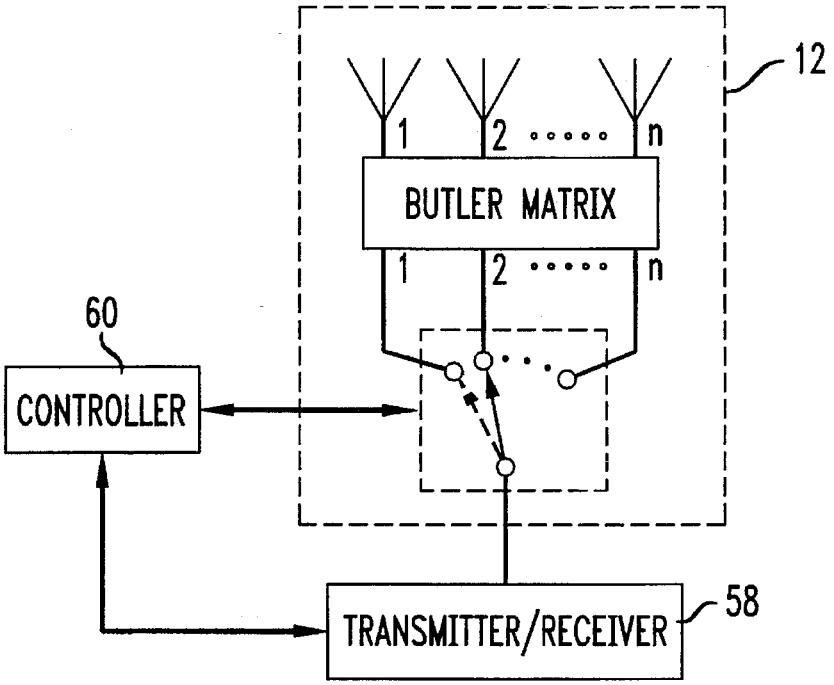
FIG. 8 is a block diagram of an exemplary configuration for a high speed wireless communication system incorporating the multilayered antenna array of FIG. 1.

Referring to FIG. 8 an exemplary communication system incorporating the integrated antenna array is shown. The system is configured to determine and select a signal path having a signal-to-noise ratio and distortion factors which satisfy predetermined threshold levels. The system 10 includes the integrated multilayered switched beam antenna array 12 described above, a transmitter/receiver network 58 and a controller 60.

As described above and shown in FIG. 8, the antenna arrays are incorporated into a high speed communication system which samples and processes the received data transmissions and which determines the optimum transmitter antenna and receiver antenna for the transmission path.

As described above, the subject matter of the present disclosure includes the utilization of the signal-to-noise ratio and multipath distortion parameters to determine the optimum transmission path. Thus, the received data transmissions are sampled and processed to determine if the signal-to-noise ratio is above a predetermined threshold and the signal distortion parameter falls below a predetermined threshold. The transmitter/receiver circuitry 58 and controller 60 sweep through and sample the incoming signals from each receiving sector (e.g., each of 16 beams of each of the seven antenna arrays) which is a total of 112 beams. Transmitter/receiver circuitry includes standard commercial equipment. U.S. Pat. No. 4,612,518 to Gans et al. describes a modulator/demodulator scheme which may be used in the transmitter/receiver circuitry, and is incorporated herein by reference. The controller processes the received signals and determines the signal-to-noise ratio and distortion parameters for each beam. Controller 60 then creates a data table which associates the best receiver sector with a particular transmitter sector so that when the receiver and particular transmitter transfer data, the store sectors will be utilized. Controller 60 is a processor controlled unit having memory, stored programs for controlling the transmitter/receiver logic and the switch matrix, and stored programs for determining the optimum transmission path described hereinbelow. An example of a suitable controller is a VXI Bus Controller model HP75000 manufactured by Hewlett Packard.

Alternatively, controller 16 may store predetermined threshold values for the signal-to-noise ratio and the distortion and may continuously monitor the received signals and when the signal-to-noise ratio falls below the threshold level and/or when the distortion increases above the threshold level, the controller again samples the signals to determine which path is the best. Another alternative technique for determining which transmitter sector and which receiver sector are the best is to continuously sample the incoming signals and determined which path is the best.

To determine the signal-to-noise ratio and the signal distortion parameters, the "eyeopening" technique is preferably utilized. The "eyeopening" technique is known and described in S. Benedetto, E. Biglieri, V. Castellani, "Digital Transmission Theory" Prentice Hall Book Co., 1987, page 278.

It will be understood that various modifications can be made to the embodiments of the present invention herein disclosed without departing from the spirit and scope thereof. For example, various types of antenna elements are contemplated as well as various types of conductive and dielectric materials for the integrated layered construction of the antenna array. Therefore, the above description should not be construed as limiting the invention but merely as exemplifications of the preferred embodiments thereof. Those skilled in the art will envision other modifications within the scope and spirit of the present invention as defined by the claims appended hereto.

What is claimed is:

1. A multilayered streamlined antenna array for forming a steerable antenna beam, comprising:

a first layer having a selectively controllable switch matrix formed thereon, said switch matrix operable to switch an RF signal between an input port thereof and any one of a plurality of output ports thereof;

a second layer displaced from said first layer, said second layer having a first array of Butler Matrices, each having a plurality of first input ports and a plurality of first output ports, wherein each of said plurality of first input ports is connected to a corresponding one of said plurality of switch matrix output ports, said first array of Butler matrices being configured to arrange the phase of said RF signal along a first axis;

a third layer displaced from said second layer, said third layer having a second array of Butler matrices, each having a plurality of second input ports and a plurality of second output ports, wherein each of said plurality of second input ports is coupled to at least one of said first output ports, said second array of Butler matrices being configured to arrange the phase of the input signal along a second axis orthogonal to said first axis;

said second output ports being connectable to a plurality of antenna elements arranged in at least a two-dimensional array to form said steerable antenna beam in a direction that is dependent on a switch position of said switch matrix.

2. The multilayered antenna array according to claim 1, further comprising a fourth layer having said plurality of antenna elements positioned thereon, wherein each one of said plurality of antenna elements is coupled to a corresponding one of said second output ports.

3. The multilayered antenna array according to claim 2, wherein said second layer is constructed in a stripline configuration.

4. The multilayered antenna array according to claim 3, wherein said stripline configuration comprises two parallel copper ground planes displaced from said second layer by dielectric material.

5. The multilayered antenna array according to claim 2, wherein said third layer is constructed in a stripline configuration.

6. The multilayered antenna array according to claim 5, wherein said stripline configuration comprises two parallel copper ground planes displaced from said third layer by dielectric material.

7. The multilayered antenna array according to claim 2, wherein said forth layer is constructed in a stripline configuration.

8. The multilayered antenna array according to claim 7, wherein said stripline configuration comprises two parallel copper ground planes displaced from said fourth layer by dielectric material.

9. The multilayered antenna array according to claim 2, wherein said switch matrix comprises cascaded diode switches.

10. The multilayered antenna array according to claim 2, wherein each of said plurality of antenna elements comprises a patch antenna.

11. A communication system for high speed wireless data transmission, which comprises:

at least one multilayered antenna array having a plurality of antenna elements positioned on a first layer coupled to a first array of Butler matrices positioned on a second layer, said first array of Butler matrices having a plurality of first outputs wherein one said first output is coupled to one of said plurality of antenna elements, and said first array of Butler matrices having a plurality of first inputs, said antenna array further including a third layer having a second array of Butler matrices having a plurality of second inputs and a plurality of second outputs, said second outputs being coupled to said first inputs, wherein data transmission signals are selectively applied to said second inputs;

a transmitter network having an output port selectively connectable to one of said second inputs, said transmitter network being configured to generate the data transmission signal; and a processor coupled to said transmitter network and means for selectively connecting said output port of said transmitter network with at least one of said plurality of second inputs.

12. The communication system according to claim 11, wherein said multilayered antenna array further comprises a fourth layer displaced from said third layer, said fourth layer having a switch matrix integrated thereon, said switch matrix having an input port coupled to the data transmission signals, and a plurality of output ports, one of said plurality of output ports being coupled to corresponding input ports of said plurality of input ports of said third layer Butler matrix array.

13. The communication system according to claim 11, further comprising a receiver network coupled to said multilayered antenna array and configured to receive data transmission signals.

14. The communication system according to claim 13, wherein said processor includes selecting means for determining which transmitter antenna element and receiver antenna element provide an optimum transmission path based upon predefined criterion.

15. The communication system according to claim 14, wherein said predefined criterion comprise signal-to-noise ratio and multipath signal distortion.

16. A method for determining the optimum transmission path in narrow beam wireless transmission networks, comprising:

determining a signal-to-noise ratio for received data transmissions and comparing said signal-to-noise ratio to a predefined threshold level;

determining a multipath distortion parameter for said received data transmissions and comparing said multipath distortion parameter to a predefined threshold level; and selecting a transmission path when said signal-to-noise ratio and said multipath distortion parameter satisfy said predetermined threshold levels.

17. A method for determining the optimum transmission path in narrow beam wireless transmission networks, comprising:

providing at least one multilayered antenna array at a transmitting location and at a receiving location, said at least one antenna array having a plurality of antenna elements positioned on a first layer coupled to at least one Butler matrix array positioned on a second layer, said Butler matrix array having a plurality of outputs wherein one output of said plurality of outputs is coupled to one of said plurality of antenna elements, and said Butler matrix array having a plurality of inputs selectively coupled to data transmission signals;

coupling a transmitter network to said antenna array at the transmitting location, said transmitter network having an output port selectively connectable to one of said plurality of inputs of said at least one Butler matrix array, said transmitter network being configured to generate the data transmission signal;

coupling a receiver network to said antenna array at the receiving location, said receiver network being configured to receive data transmission signals;

determining a signal-to-noise ratio for received data transmissions and comparing said signal-to-noise ratio to a predefined threshold level;

determining a multipath distortion parameter for said received data transmissions and comparing said multipath distortion parameter to a predefined threshold level; and selecting a transmission path between the transmitter and receiver locations when said signal-to-noise ratio and said multipath distortion parameter satisfy said predetermined threshold levels.

18. A multilayered antenna feed network for forming a steerable antenna beam, comprising:

a first layer having a first array of Butler matrices, each having a plurality of first input ports for selectively receiving or providing an RF signal, said first array of Butler matrixes further having a plurality of first output ports and being operable to arrange the phase of said RF signal along a first axis to thereby steer said antenna beam along said first axis;

a second layer facing said first layer, said second layer having a second array of Butler matrices, each having a plurality of second input ports and a plurality of second output ports, each of said second input ports being coupled to at least one of said first output ports such that said second array of Butler matrices is configured to arrange the phase of said RF signal along a second axis orthogonal to said first axis to thereby steer said antenna beam along said second axis, said second output ports being connectable to a plurality of antenna elements arranged in at least a two dimensional array to form said steerable antenna beam.

19. The multilayered antenna feed network according to claim 18, further comprising a third layer having a selectively controllable switch matrix formed thereon, said switch matrix having an input port and a plurality of output ports, said plurality of output ports of said third layer being respectively coupled to said plurality of first input ports of said first layer.

20. The feed network according to claim 18, further including a third layer facing said second layer, said third layer having said plurality of antenna elements arranged in a planar array.

21. The feed network according to claim 20, wherein said antenna elements comprise microstrip patch antenna elements.

22. The feed network according to claim 18, wherein:

the first array of Butler matrices comprise a plurality N of first M×M Butler matrices each arranged parallel to one another, and each having a surface area occupying a rectangular platform having two long sides and two short sides;

the second array of Butler matrices comprise a plurality N of second M×M Butler matrices each arranged parallel to one another and each having a surface area occupying a rectangular platform having two long sides and two short sides, the long sides of the second Butler matrices' rectangular platforms being substantially orthogonal to the long sides of the first Butler matrices' rectangular platforms.

23. The feed network according to claim 22, wherein the long sides of the first Butler matrices' rectangular platforms lie parallel to the first axis and the long sides of the second Butler matrices' rectangular platforms lie parallel to the second axis.

24. The feed network according to claim 23, further including a third layer facing said second layer, said third layer having said plurality of antenna elements arranged in a planar array, wherein each one of said antenna elements is coupled to an associated one of said second output ports of said second array of Butler matrices.

25. The antenna feed network according to claim 18, wherein said feed network is configured to transmit said RF signal via said steerable antenna beam.

26. The antenna feed network according to claim 18, wherein said feed network is configured to receive said RF signal via said steerable antenna beam.

* * * * *